US006457706B1

(12) United States Patent
Sheng et al.

(10) Patent No.: US 6,457,706 B1
(45) Date of Patent: Oct. 1, 2002

(54) PAPER PICK-UP MECHANISM OF AN AUTOMATIC DOCUMENT FEEDER

(75) Inventors: Thomas Sheng, Hsinchu (TW); Chi-Yao Chen, Hsinchu (TW)

(73) Assignee: Avision Inc., Hsinchu (TW)

( * ) Notice: Subject to any disclaimer, the term of this patent is extended or adjusted under 35 U.S.C. 154(b) by 92 days.

(21) Appl. No.: 09/773,080

(22) Filed: Feb. 1, 2001

(30) Foreign Application Priority Data

Dec. 18, 2000 (TW) ..... 89127051 A

(51) Int. Cl.[7] ..... B65H 3/06

(52) U.S. Cl. ..... 271/109

(58) Field of Search ..... 271/4.1, 16.19, 271/21–23, 34, 109–127; 347/216; 358/498; 400/578, 625, 629; 414/797.3, 797.7

(56) References Cited

U.S. PATENT DOCUMENTS 5,899,450 A * 5/1999 Gettelfinger et al. ..... 271/121
6,352,256 B1 * 3/2002 Hsieh ..... 271/110
6,382,619 B1 * 5/2002 Gustafson et al. ..... 271/117

FOREIGN PATENT DOCUMENTS

JP 4-55239 * 2/1994

* cited by examiner

*Primary Examiner*—Donald P. Walsh
*Assistant Examiner*—Kenneth W Bower
(74) *Attorney, Agent, or Firm*—Charles E. Baxley

(57) ABSTRACT

The present invention includes at least one friction member module frictionally and rotatably mounted on a frame. When the friction member module is rotated, the friction between the frame and the friction member module is converted into a torque which is exerted on the frame, so that the frame can be swayed to a paper taking position, thereby facilitating feeding paper automatically.

9 Claims, 16 Drawing Sheets

PAPER PICK-UP MECHANISM OF AN AUTOMATIC DOCUMENT FEEDER

BACKGROUND OF THE INVENTION

1. Field of the Invention

The present invention relates to a paper pick-up mechanism of an automatic document feeder used for a scanning device, a photocopying machine, a printing machine, or a faxing machine etc.

2. Description of the Related Prior Art

An automatic document feeder (ADF) is mounted on an image capturing device or a printing device, so that multiple sheets of papers can be continuously input. The paper tray in the ADF equipment is usually arranged with an inclined angle greater than 15 degrees, whereby when the paper is placed in the paper tray, it can slide into a paper stand-by position by its own weight. This kind of inclined design has the function of feeding paper automatically. However, it occupies a large space.

The closest prior art of which the applicant is aware is disclosed in U.S. Pat. No. 5,344,134, which disclosed an automatic document feeder of a platform type.

In the automatic document feeder of an inclined type or a platform type, the sensor detects the paper when the paper is fed, then, a power device, such as a motor, supplies power to drive a link mechanism or lever member, so that a pick-up roller sways to and contacts with the paper automatically, so as to feed paper automatically. After all of the papers are input, the sensor detects that there is no paper, the motor rotates reversely to drive the link mechanism or lever member, so that the pick-up roller may be lifted to return to the stand-by position, thereby facilitating the user placing the paper again.

In such a manner, the pick-up roller is moved by the motor rotating normally or reversely to drive the link mechanism or lever member. Therefore, the design of the link mechanism or lever member has to be precise, and has to co-operate with other detecting and control members and related circuits, causing the design to be complicated. In addition, after the automatic document feeder accomplishes feeding papers, the motor has to rotate reversely to drive the link mechanism or lever member for lifting the pick-up roller, causing the motor to be frequently used.

SUMMARY OF THE INVENTION

The present invention provides a design which employs the action of a friction being converted into a torque, so that a frame provided with a friction member module can away in a lever manner, thereby automatically feeding papers.

For achieving the above objective, a friction member module is frictionally and rotatably mounted on a frame, and one face of the friction member module is provided with a friction face rested on the frame. When the friction member module is rotated, the friction between the frame and the friction member module exerts a torque action on the frame, so that the frame can be swayed by pivot shafts.

The friction member module may be a friction block, or any member mounted on the frame, such as an automatic paper feeding roller, a pick-up roller, or a belt for connecting the automatic paper feeding roller and the pick-up roller.

When there is no paper, one end of the frame can be lifted by a lever action, thereby facilitating the user placing the paper again. The frame may be provided with a counterweight which acts so that one end of the frame can be lifted automatically when there is no paper, thereby facilitating the user placing the paper again. The frame can also be lifted automatically by an elastic member.

The counterweight may be provided with a plurality of detachable adjusting counterweight units, thereby facilitating adjusting a counterweight proportion required for adjusting the lever motion of the frame.

Further benefits and advantages of the present invention will become apparent after a careful reading of the detailed description with appropriate reference to the accompanying drawings.

DETAILED DESCRIPTION OF THE INVENTION

Figure 1:
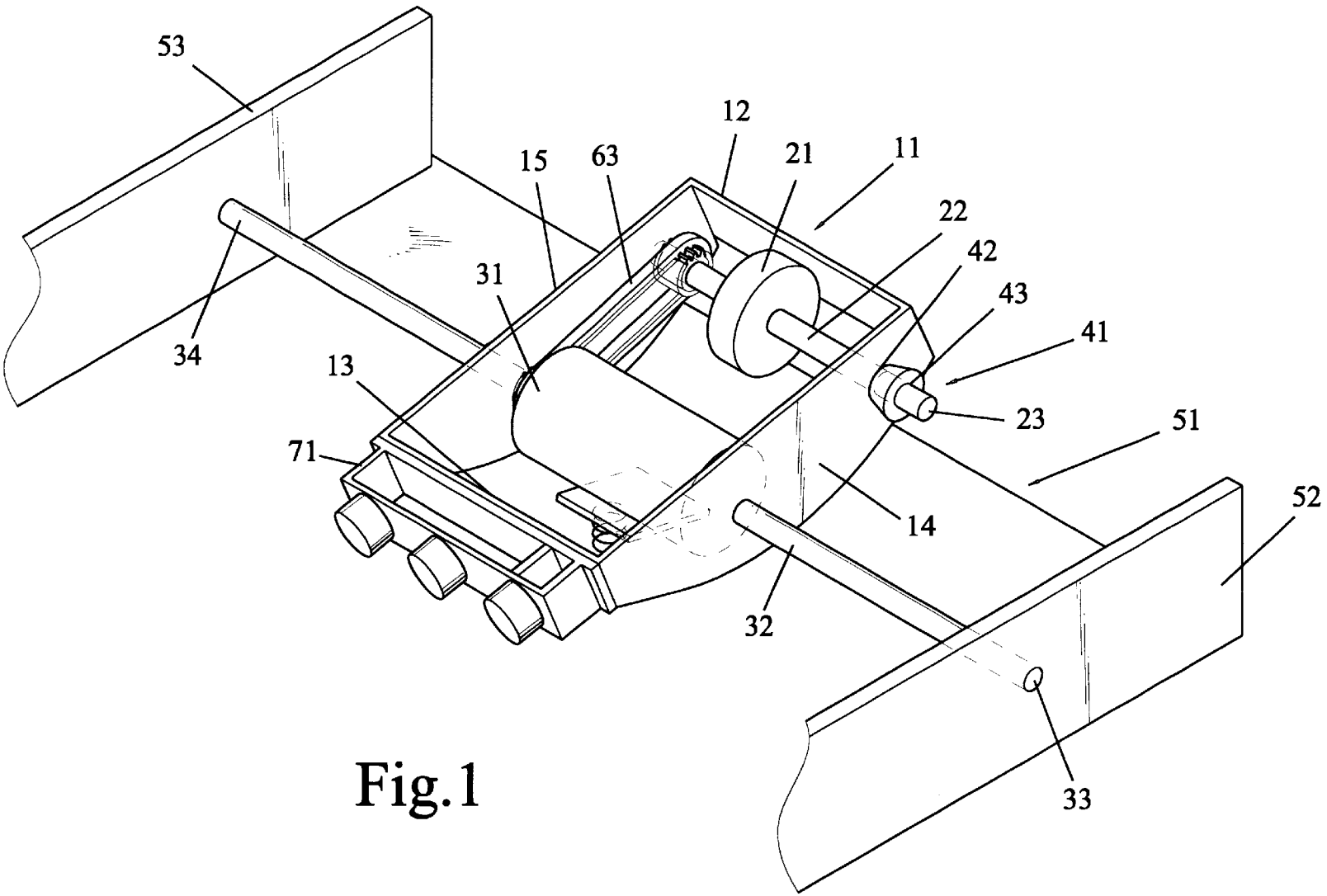
FIG. 1 is a perspective view of a paper pick-up mechanism of an automatic document feeder in accordance with the present invention.
Figure 2:
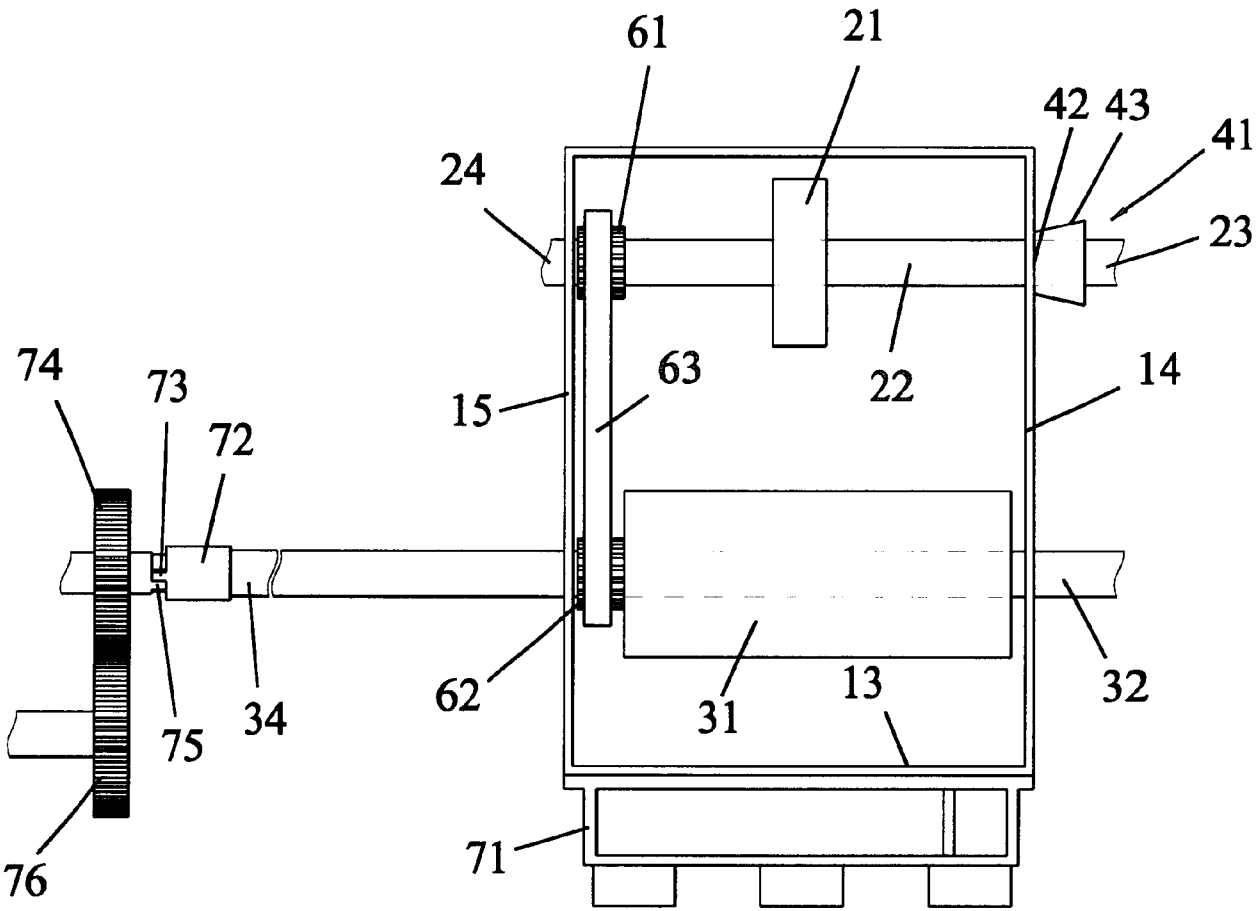
FIG. 2 is a top plan view of the paper pick-up mechanism of an automatic document feeder as shown in FIG. 1.

Referring to the drawings and initially to FIGS. 1 and 2, a paper pick-up mechanism of an automatic document feeder (ADF) in accordance with the present invention comprises a frame 11, a pick-up roller 21 rotatably mounted on the frame 11, an automatic paper feeding roller 31 rotatably mounted on the frame 11 relative to the pick-up roller 21, and a friction member module 41 frictionally mounted on the frame 11 and in contact with the frame 11. The pick-up roller 21 and the automatic paper feeding roller 31 may be individual or be associated to be called a pick-up member for providing an automatic paper feeding function.

The pick-up roller 21 is axially provided with a shaft 22 which is located adjacent to a first end face 12 of the frame 11. The shaft 22 has a first end 23 pivoted on a first side 14 of the frame 11, and a second end 24 pivoted on a second side 15 of the frame 11.

The automatic paper feeding roller 31 is axially provided with a shaft 32 which is located adjacent to a second end face 13 of the frame 11. The shaft 32 has a first end 33 extending through the first side 14 of the frame 11 and pivoted to a first side 52 of a platform 51, and a second end 34 extending through the second side 15 of the frame 11 and pivoted to a second side 53 of the platform 51. Accordingly, the frame 11 is supported by the shaft 32 to form a hanging shape and can be swayed.

The pick-up roller 21 and the automatic paper feeding roller 31 are oppositely installed in the frame 11, and the shaft 22 is provided with a gear 61 located adjacent to the second end 24. The shaft 32 is provided with a gear 62, and a belt 63 is mounted between the two gears 61 and 62, so that the pick-up roller 21 and the automatic paper feeding roller 31 may be rotated synchronously at the same speed.

The friction member module 41 may be a friction block 43 made of rubber, which is mounted on the first end 23 of the shaft 22 of the pick-up roller 21, and has one end provided with a contact face 42 rested on the first side 14 of the frame 11.

Figure 3:
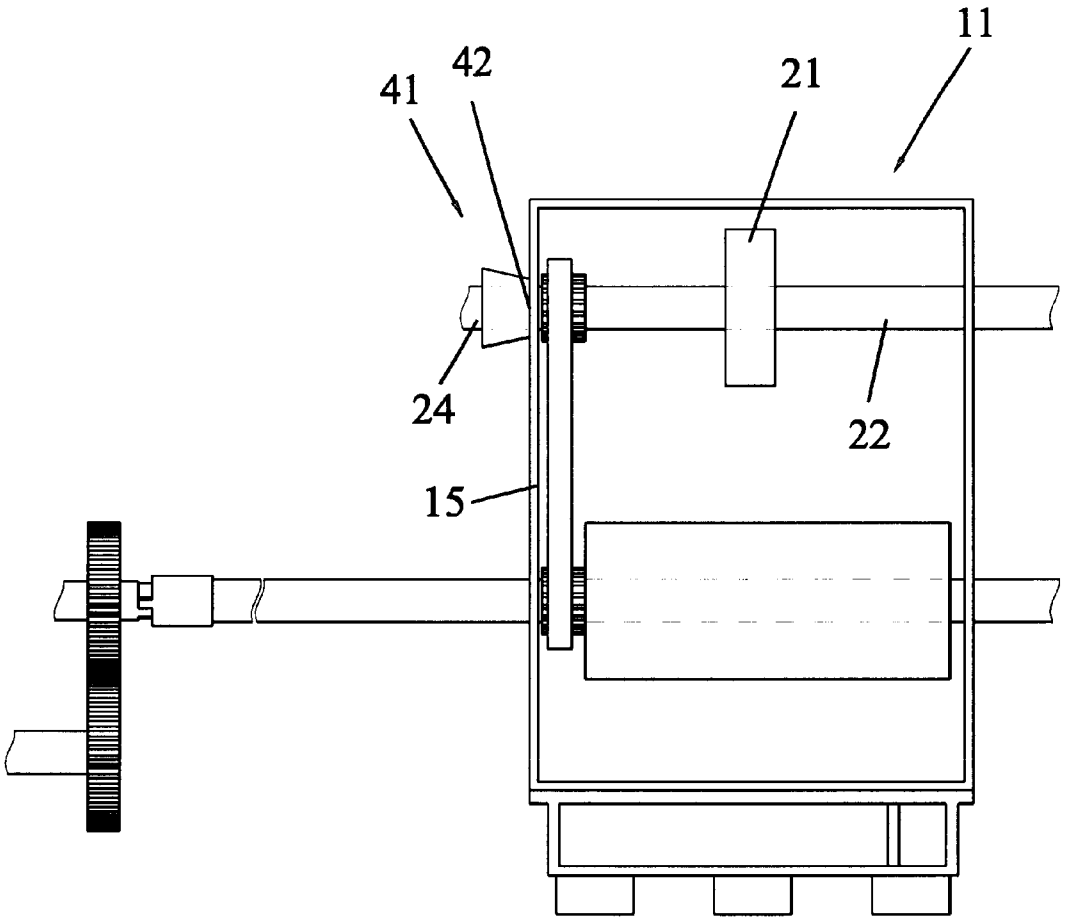
FIG. 3 is a top plan view of the paper pick-up mechanism of an automatic document feeder in accordance with another embodiment of the present invention.

Referring to FIG. 3, the friction member module 41 may be mounted on the second end 24 of the shaft 22 of the pick-up roller 21, and has one end provided with a contact face 42 rested on the second side 15 of the frame 11.

Figure 4:
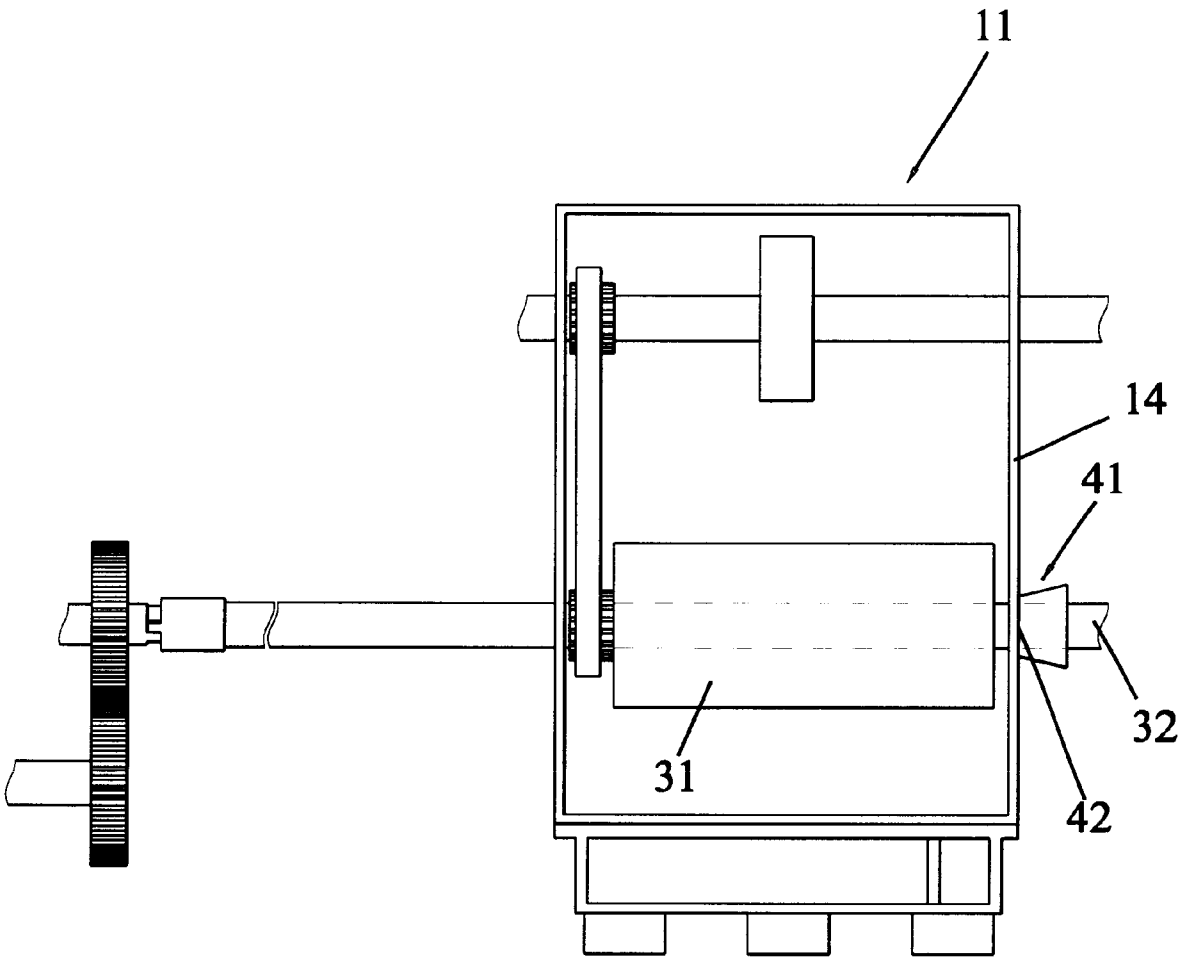
FIG. 4 is a top plan view of the paper pick-up mechanism of an automatic document feeder in accordance with a further embodiment of the present invention.
Figure 5:
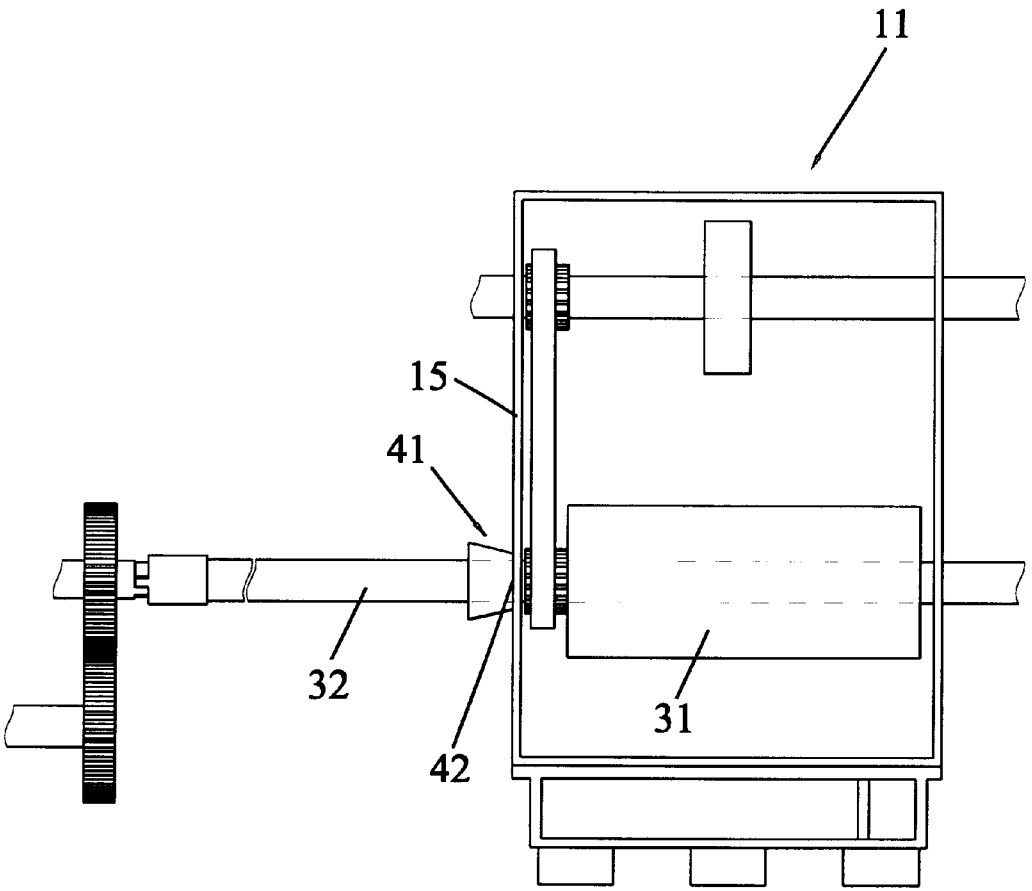
FIG. 5 is a top plan view of the paper pick-up mechanism of an automatic document feeder in accordance with a further embodiment of the present invention.

Referring to FIG. 4, the friction member module 41 may be mounted on the shaft 32 of the automatic paper feeding roller 31, and has one end provided with a contact face 42 rested on the first side 14 of the frame 11. Referring to FIG. 5, the friction member module 41 may be mounted on the shaft 32 of the automatic paper feeding roller 31, and has one end provided with a contact face 42 rested on the second side 15 of the frame 11.

Again referring to FIGS. 1 and 2, the second end face 13 of the frame 11 is provided with a counterweight 71, while the second end 34 of the shaft 32 is provided with a clutch block 72 which is provided with a flange 73. The second end 34 of the shaft 32 is fitted with a transmission member 74 which is axially provided with a flange 75 mating with the flange 73 of the clutch block 72 whereby the flange 75 of the transmission member 74 may be rested on or detached from the flange 73 of the clutch block 72, thereby forming a one-way clutch. In addition, one side of the transmission member 74 is provided with another transmission member 76 which can supply power to the transmission member 74.

Figure 6:
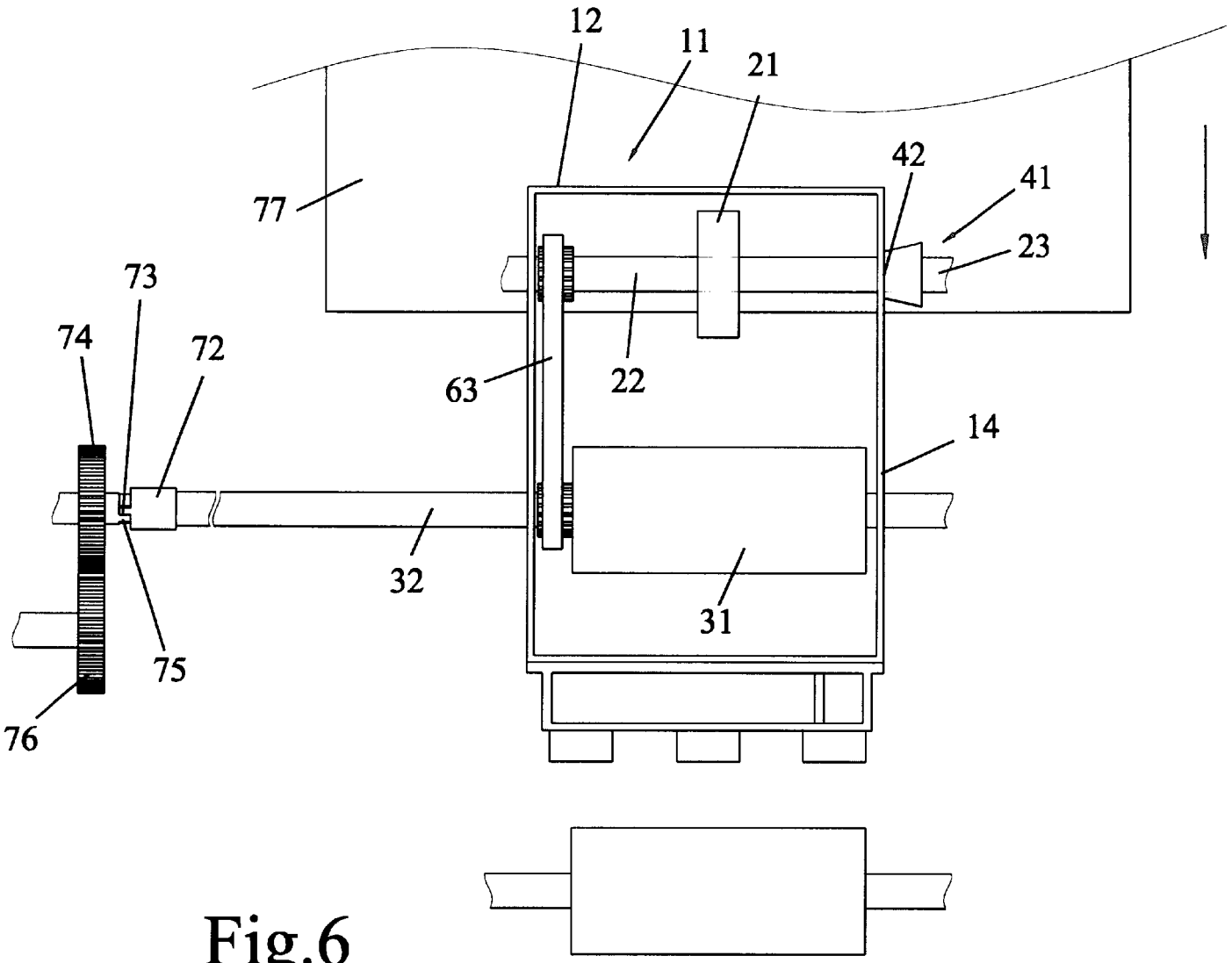
FIG. 6 is an operational view of the paper pick-up mechanism of an automatic document feeder as shown in FIG. 2.
Figure 7:
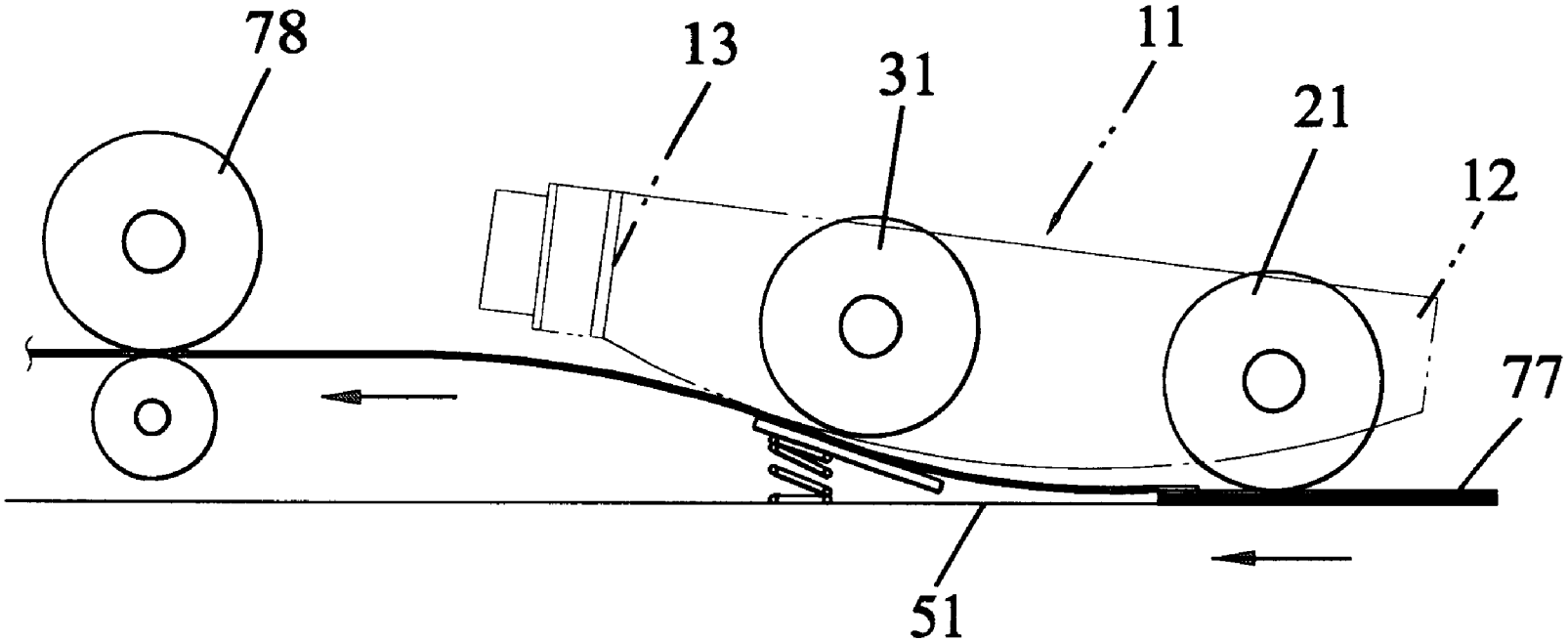
FIG. 7 is a side plan schematic operational view of the paper pick-up mechanism of an automatic document feeder as shown in FIG. 1.

Referring to FIGS. 6 and 7, when the transmission member 76 supplies power to the transmission member 74, the flange 75 is rotated by the transmission member 74 to abut the flange 73 of the clutch block 72, thereby driving and rotating the shaft 32. The shaft 32 during rotation may rotate the automatic paper feeding roller 31, while the shaft 22 and the pick-up roller 21 can also be rotated by transmission of the belt 63, and the pick-up roller 21 and the automatic paper feeding roller 31 may be rotated synchronously at the same speed.

When the shaft 22 is rotated, the friction member module 41 mounted on the first end 23 of the shaft 22 may be rotated synchronously. The friction face 42 of the friction member module 41 contacts the first side 14 of the frame 11, whereby the friction between the friction member module 41 and the frame 11 is converted into a torque which is acted on the frame 11. In such a manner, the frame 11 co-operates with the shaft 32 of the automatic paper feeding roller 31 to sway in a lever manner, so that the first end face 12 of the frame 11 is swayed downward.

Accordingly, when the sensor (not shown) detects that the paper 77 is placed between the platform 51 and the frame 11, the frame 11 is swayed downward by the friction being converted into the torque, so that the pick-up roller 21 contacts the paper 77.

Figure 8:
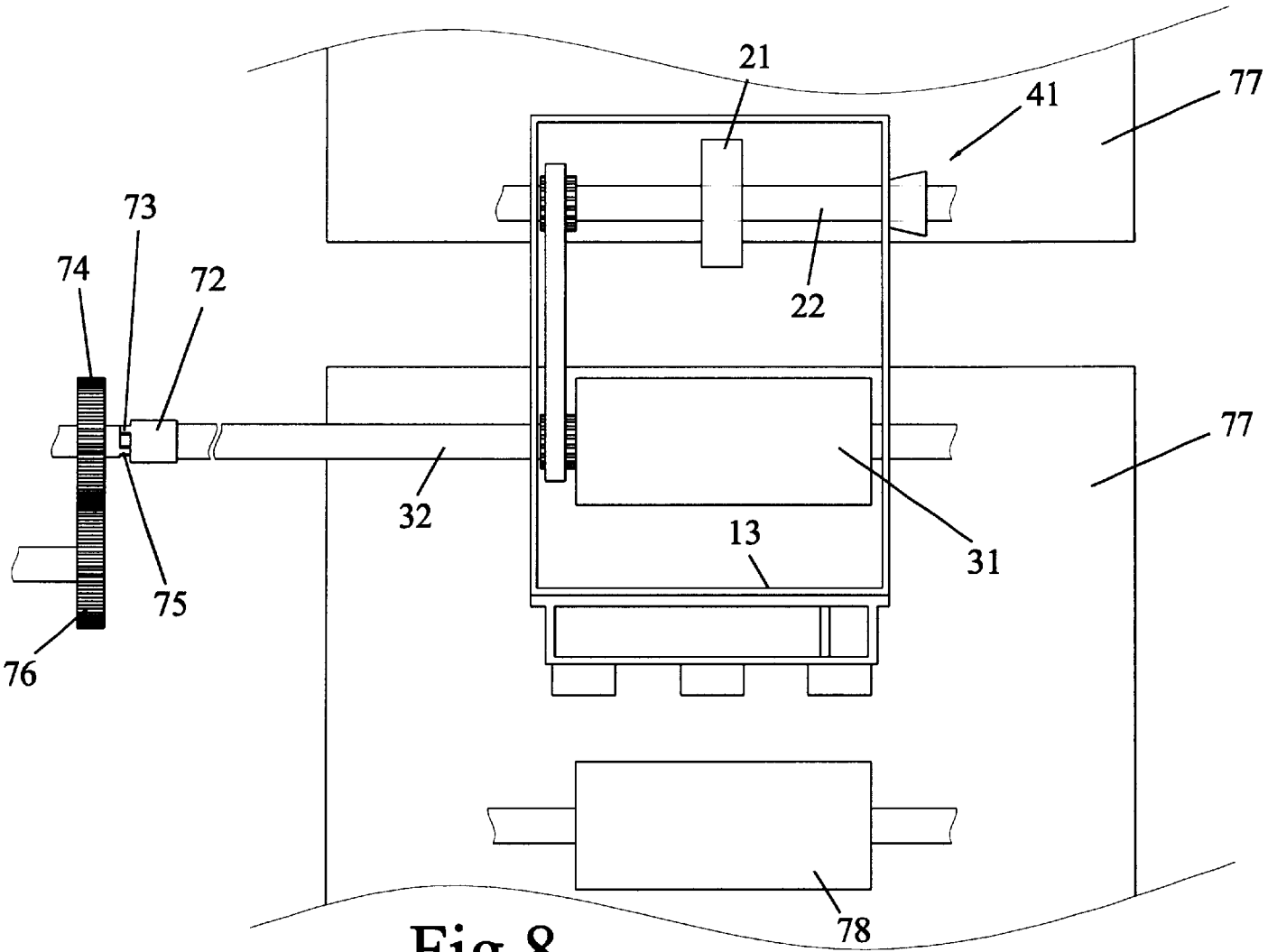
FIG. 8 is an operational view of the paper pick-up mechanism of an automatic document feeder as shown in FIG. 6.

Referring to FIGS. 7 and 8, a paper feeding roller 78 is mounted on the rear of the second end face 13 of the frame 11, and has a rotational speed greater than that of the transmission member 76. Therefore, during paper feeding process of the paper 77, the paper 77 is rapidly pulled by the paper feeding roller 78 once the paper 77 contacts the paper feeding roller 78. Meanwhile, the contact portion of the paper 77 with the automatic paper feeding roller 31 will accelerate the automatic paper feeding roller 31 and the shaft 32, whereby the rotational angle of the shaft 32 is greater than that of the transmission member 74, so that the flange 73 of the clutch block 72 exceeds and detach the flange 75 of the transmission member 74.

The automatic paper feeding roller 31 and the pick-up roller 21 are rotated continuously, whereby the friction member module 41 exerts a torque on the frame 11 continuously, so that the pick-up roller 21 contacts the paper 77, thereby preventing the frame 11 from being not able to sway downward due to the flange 73 of the clutch block 72 being detached from the flange 75 of the transmission member 74.

Before the distal end of the paper 77 leaves the automatic paper feeding roller 31, the flange 75 of the transmission member 74 cannot catch up with the flange 73 of the clutch block 72 due to the differential of the rotational speed. After the distal end of the paper 77 leaves the automatic paper feeding roller 31, the automatic paper feeding roller 31 is located at a stationary state, so that the next paper 77 cannot be fed. When the flange 75 of the transmission member 74 catches up with the flange 73 of the clutch block 72, the shaft 32 and the automatic paper feeding roller 31 are rotated, while the pick-up roller 21 is also rotated synchronously at the same speed, to drive the paper 77 to move forward. Accordingly, two sheets of adjacent papers 77 are spaced with a distance, so that the papers 77 can be moved separately.

Figure 9:
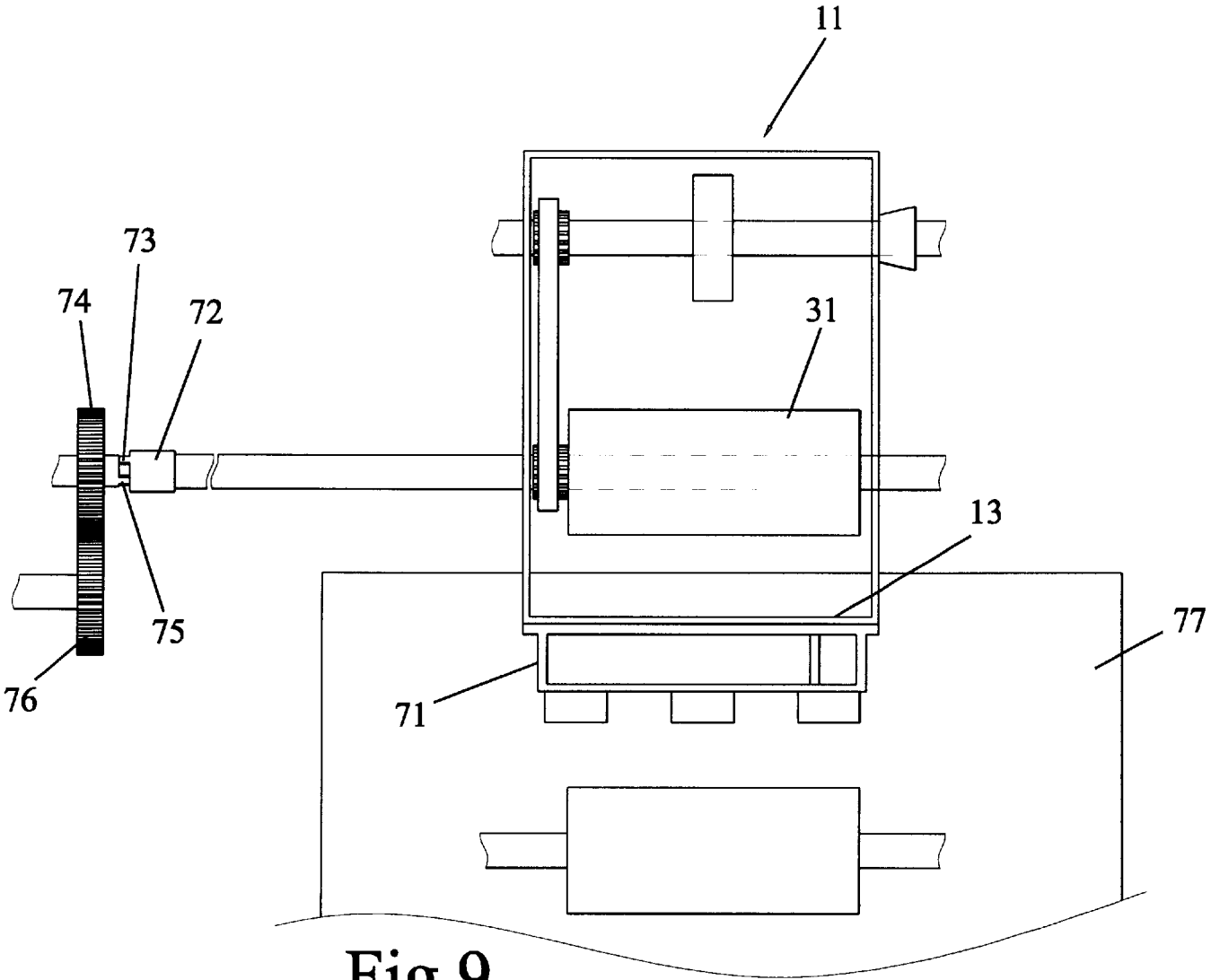
FIG. 9 is an operational view of the paper pick-up mechanism of an automatic document feeder as shown in FIG. 8.
Figure 10:
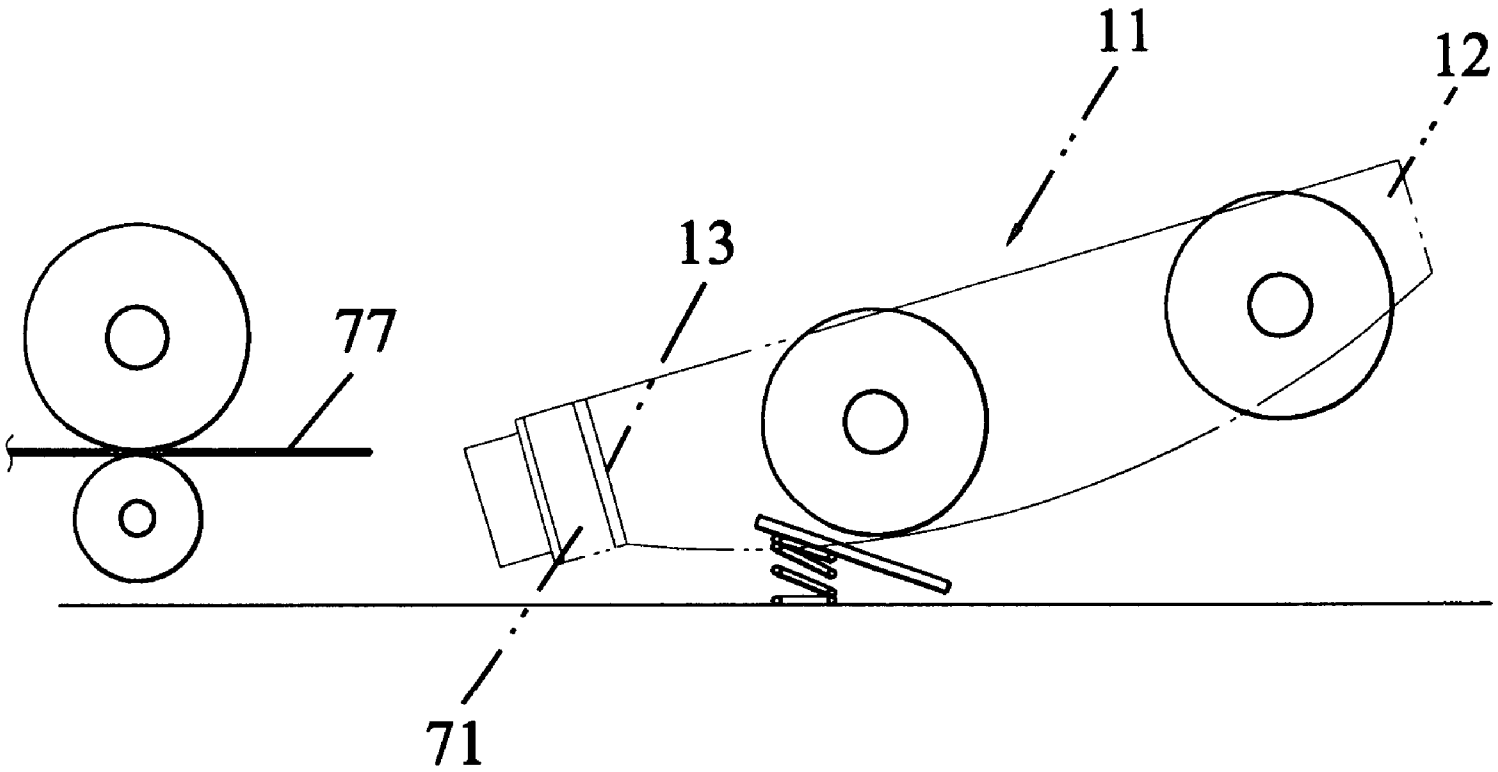
FIG. 10 is a side plan schematic operational view of the paper pick-up mechanism of an automatic document feeder as shown in FIG. 1.

Referring to FIGS. 9 and 10, the transmission member 76 will stop operating when the sensor detects that the last paper 77 leaves the automatic paper feeding roller 31, so that the transmission member 74 stops operating. At this time, the flange 73 of the clutch block 72 is spaced from the flange 75 of the transmission member 74 with a distance. The frame 11 is subjected to the action of the counterweight 71 co-operating with the distance of the flanges 73 and 75, so that the second end face 13 is swayed downward, thereby lifting the first end face 12 and facilitating the user placing the paper 77 under the frame 11.

Figure 11:
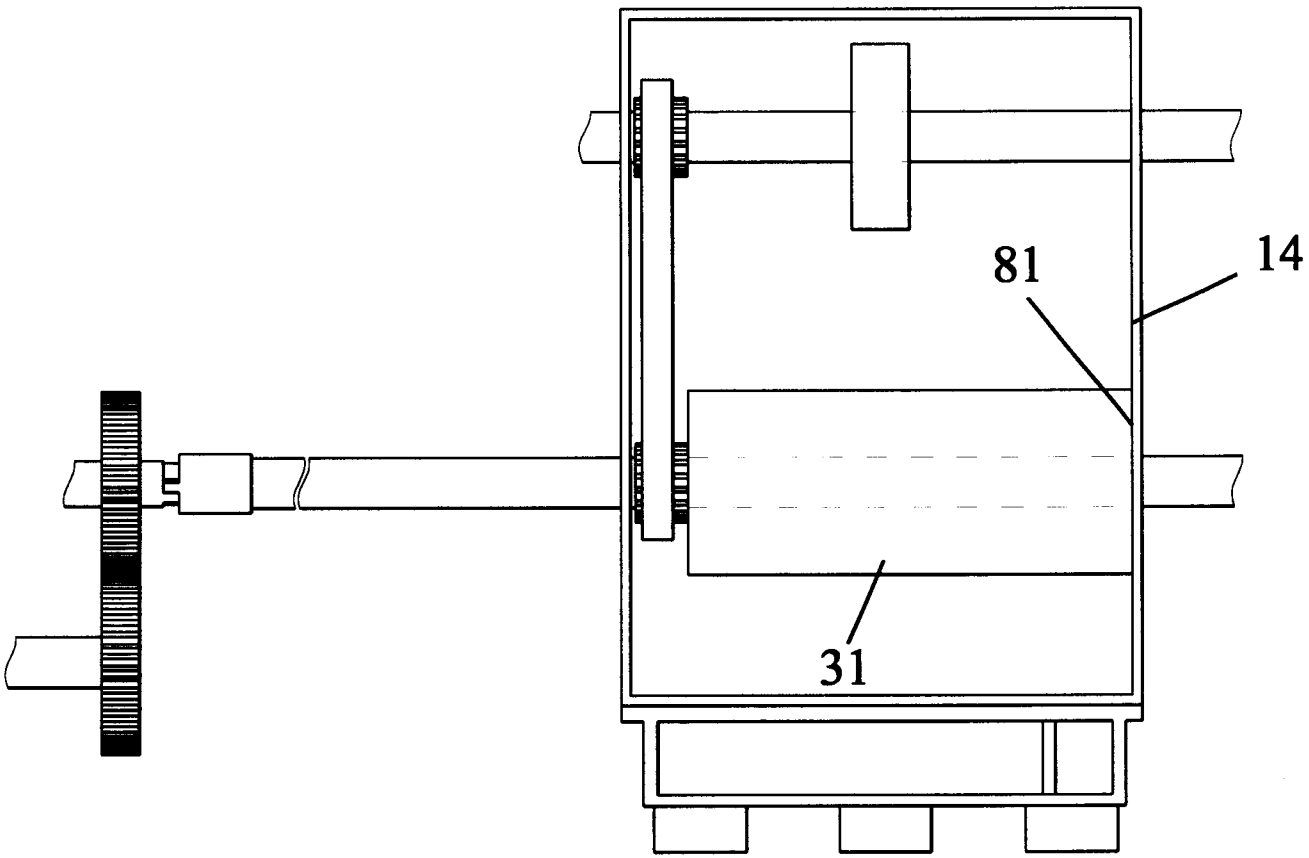
FIG. 11 is a top plan view of the paper pick-up mechanism of an automatic document feeder in accordance with a further embodiment of the present invention.

The friction member module 41 used in the present invention is not limited to use the friction block 43. In the other embodiments of the present invention, the friction member module 41 may be other member mounted in the frame 11 for producing the automatic papers feeding function. Referring to FIG. 11, one end of the automatic paper feeding roller 31 is provided with a friction face 81 which is rested on the first side face 14 of the frame 11. Thus, when the automatic paper feeding roller 31 is rotated, the friction face 81 exerts a torque on the frame 11, thereby forcing the frame 11 to sway downward in order to feed the paper automatically.

Figure 12:
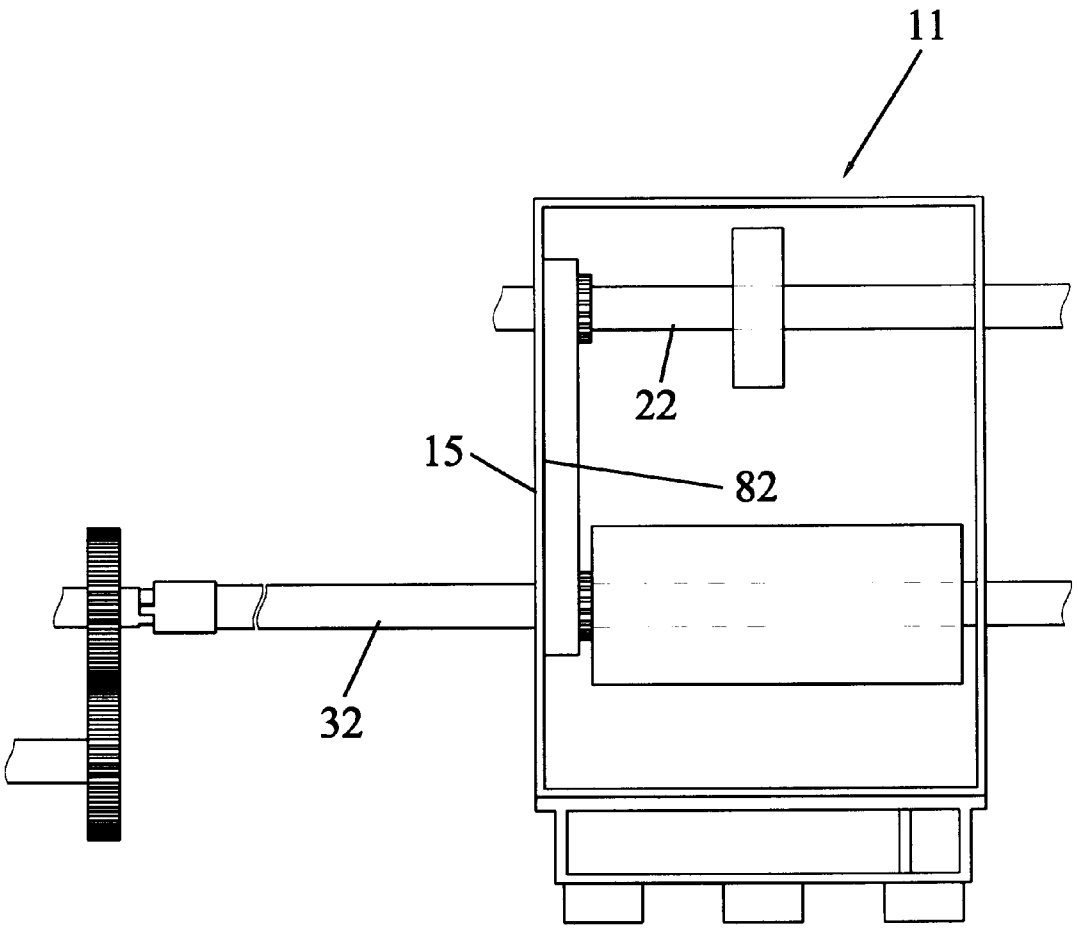
FIG. 12 is a top plan view of the paper pick-up mechanism of an automatic document feeder in accordance with a further embodiment of the present invention.

Referring to FIG. 12, one side of the belt 63 for connecting the shaft 32 of the automatic paper feeding roller 31 and the shaft 22 of the pick-up roller 21 is provided with a friction face 82 which is rested on the second side face 15 of the frame 11. Thus, when the belt 63 is rotated, the friction face 82 exerts a torque on the second side 15 of the frame 11, thereby forcing the frame 11 to sway downward to feed the paper automatically.

Figure 13:
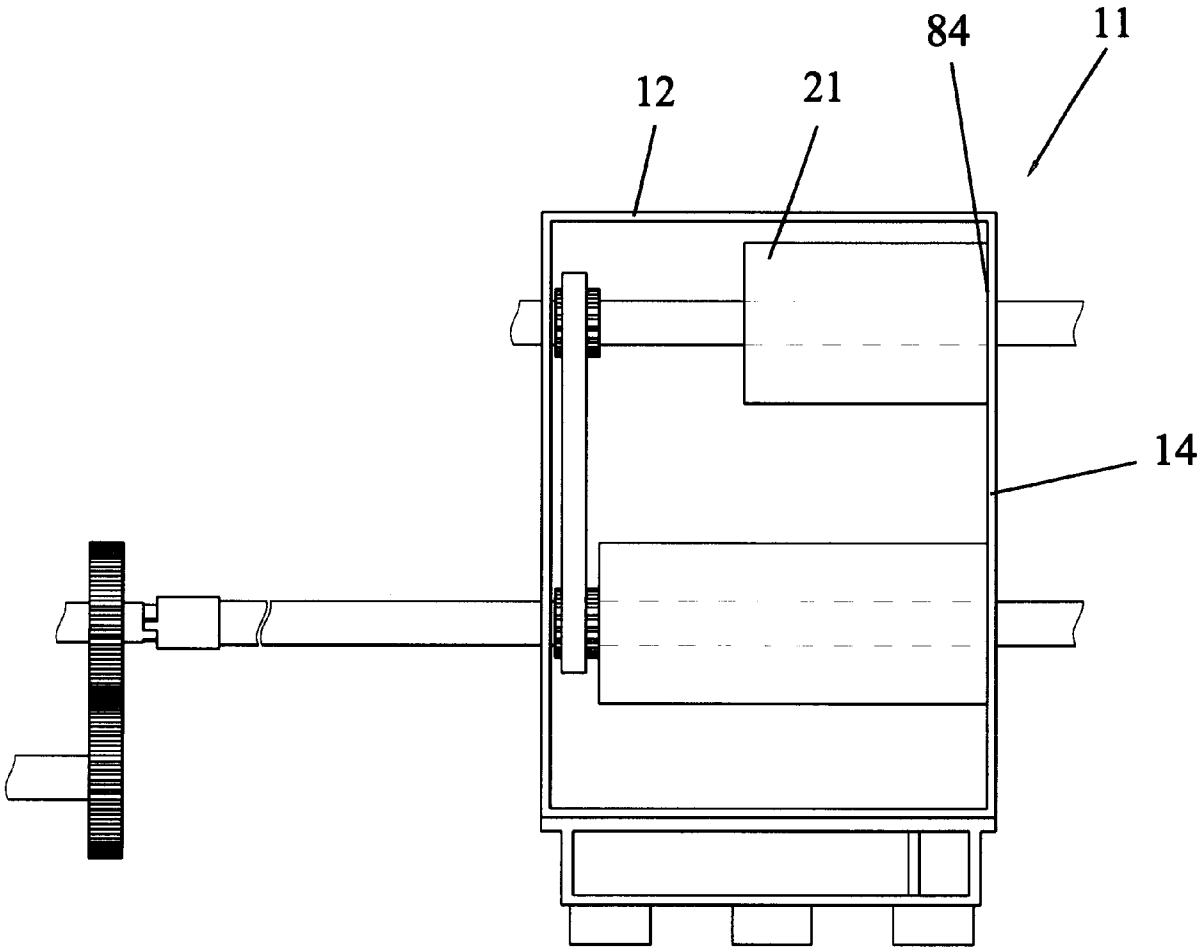
FIG. 13 is a top plan view of the paper pick-up mechanism of an automatic document feeder in accordance with a further embodiment of the present invention.

Referring to FIG. 13, one end of the automatic pick-up roller 21 is provided with a friction face 84 which is rested on the first side face 14 of the frame 11. Thus, when the automatic pick-up roller 21 is rotated, the friction face 84 exerts a torque on the frame 11, thereby forcing the first side 14 of the frame 11 to sway downward to feed the paper automatically.

Figure 14:
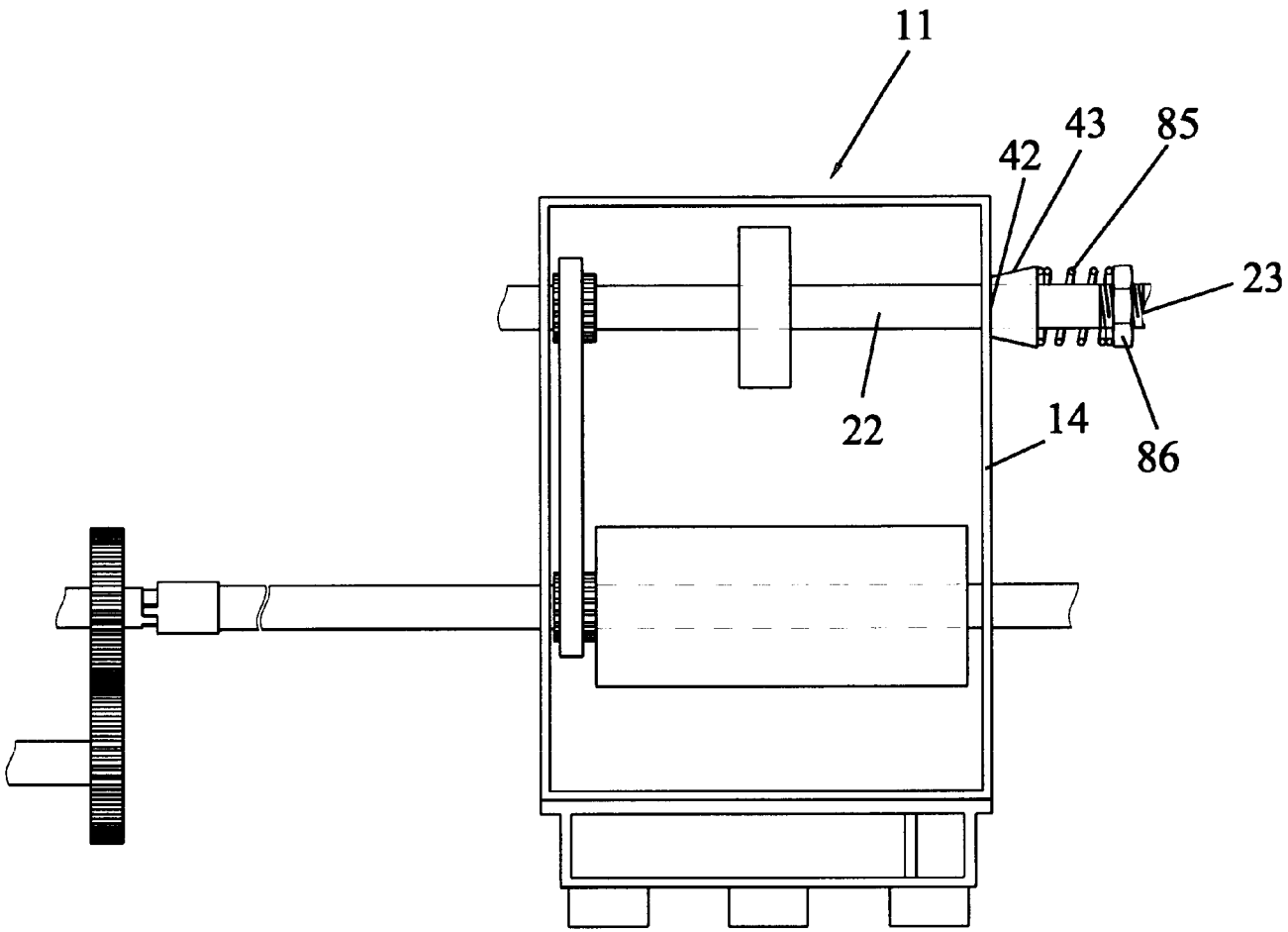
FIG. 14 is a top plan view of the paper pick-up mechanism of an automatic document feeder in accordance with a further embodiment of the present invention.

Referring to FIG. 14, a tension adjustable spring 85 mounted on the first end 23 of the shaft 22 acts on the friction block 43 to provide an urging force of the contact face 42 of the friction block 43 with the first side 14 of the frame 11. For example, one end of the spring 85 is provided with an adjusting block 86 which may be displaced with rotation, for adjusting a normal force of the friction block 43 on the first side 14 of the frame 11 at shipping, so that the torque produced by the friction is large enough to force the frame 11 to sway.

Figure 15:
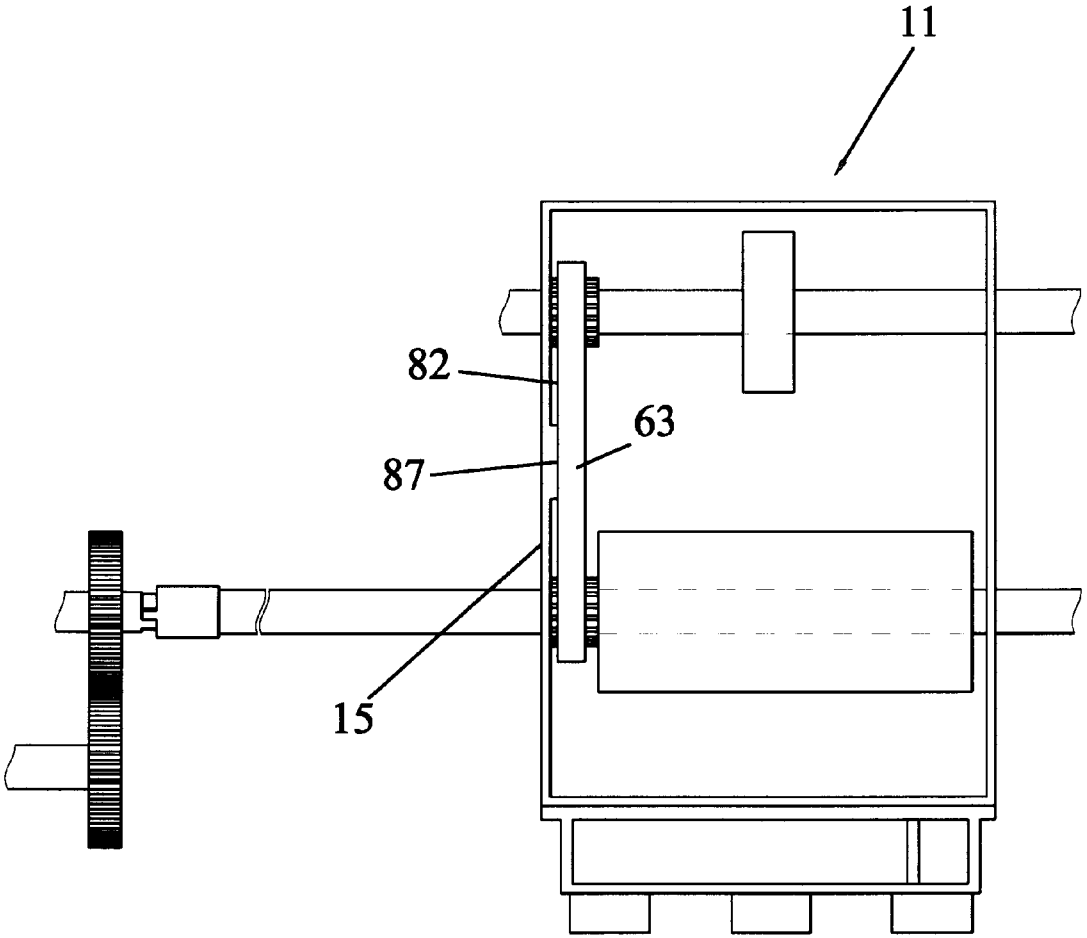
FIG. 15 is a top plan view of the paper pick-up mechanism of an automatic document feeder in accordance with a further embodiment of the present invention.

Referring to FIG. 15, according to another embodiment of the present invention, the inner wall of the second side 15 of the frame 11 is provided with a protrusion 87, whereby when the belt 63 is rotated, the friction produced by the friction face 82 in contact with the protrusion 87 will force the frame 11 to sway.

According to another embodiment not shown in the figures, the gear 61 or the gear 62 remains a frictional relationship with the second side 15 of the frame 11, thereby also achieving the effect of swaying the frame 11

Figure 16:
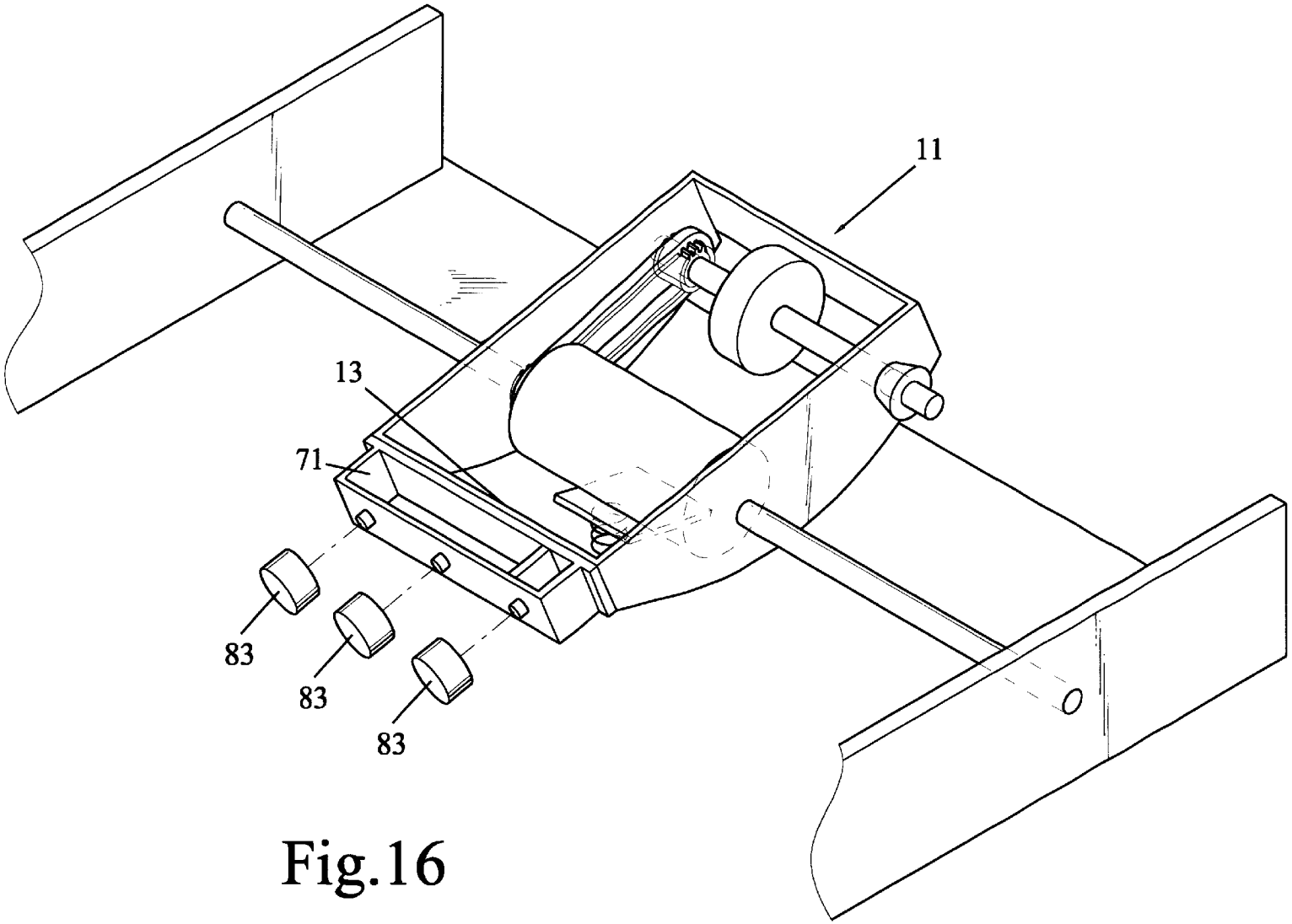
FIG. 16 is a perspective view of the paper pick-up mechanism of an automatic document feeder in accordance with a further embodiment of the present invention.

Referring to FIG. 16, the counterweight 71 is further provided with a plurality of detachable adjusting counterweight units 83, thereby facilitating adjusting a counterweight proportion required for adjusting a lever motion of the frame 11, so that the frame 11 can be swayed more conveniently and sensibly.

According to another embodiment not shown in the figures, a spring (not shown) may be used to replace the counterweight 71 or the adjusting counterweight units 83, so that the frame 11 can be automatically swayed to a stand-by position by action of the spring, thereby facilitating the user sending the next batch of papers to be processed. For example, the spring is mounted between the frame 11 and the platform 51 without affecting paper feeding, so that the frame 11 can be automatically swayed to a stand-by position when the torque is removed.

Accordingly, the present invention employs the action of a friction being converted into a torque, so that the frame 11 can away in a lever manner. In addition, the frame 11 co-operates with the friction member module 41 to simplifying the construction. Further, one end of the frame 11 can be lifted automatically without any power by means of the design of the counterweight 71, thereby reducing use of the motor.

It should be clear to those skilled in the art that further embodiments may be made without departing from the scope of the present invention.

What is claimed is:

1. A paper pick-up mechanism of an automatic document feeder, comprising:

a frame;

at least one pick-up member, rotatably mounted on the frame; and at least one friction member module, frictionally mounted on the frame and in contact with the frame, wherein, the friction member module exerts a torque action on the frame by friction during rotation, so that the frame sways, and the pick-up member can automatically pick up paper.

2. The paper pick-up mechanism of an automatic document feeder in accordance with claim 1, wherein the friction member module is a friction block which moves in concert with the pick-up member, and has one end provided with a friction face in contact with a surface of the frame.

3. The paper pick-up mechanism of an automatic document feeder in accordance with claim 1, wherein the friction member module is integrally formed with the pick-up member, and the pick-up member has one end provided with a friction face rested on the frame.

4. The paper pick-up mechanism of an automatic document feeder in accordance with claim 1, wherein the friction member module is a belt mounted on the frame for driving the pick-up member, and the belt has one side provided with a friction face rested on the frame.

5. The paper pick-up mechanism of an automatic document feeder in accordance with claim 1, wherein the friction member module co-operates with a tension adjustable spring for adjusting a normal force on the frame.

6. The paper pick-up mechanism of an automatic document feeder in accordance with claim 4, wherein the frame is provided with a protrusion in contact with the friction face of the belt.

7. The paper pick-up mechanism of an automatic document feeder in accordance with claim 1, wherein the frame has one end provided with a counterweight, so that the frame can be swayed to a stand-by position by action of the counterweight when there is no paper.

8. The paper pick-up mechanism of an automatic document feeder in accordance with claim 7, wherein the counterweight is provided with a plurality of detachable adjusting counterweight units, thereby facilitating adjusting a counterweight proportion required for adjusting a lever motion of the frame.

9. The paper pick-up mechanism of an automatic document feeder in accordance with claim 1, wherein the frame is provided with a spring, so that the frame can be swayed to a stand-by position by action of the spring when there is no paper.

* * * * *